US011039506B2

(12) United States Patent
Hicks et al.

(10) Patent No.: US 11,039,506 B2
(45) Date of Patent: Jun. 15, 2021

(54) STOVE CONTROL SAFETY MECHANISM

(71) Applicant: International Business Machines Corporation, Armonk, NY (US)

(72) Inventors: Andrew C. M. Hicks, Wappingers Falls, NY (US); Michael P. Lyons, Poughkeepsie, NY (US); Tynan J. Garrett, Poughkeepsie, NY (US); Yunli Tang, Wappingers Falls, NY (US)

(73) Assignee: International Business Machines Corporation, Armonk, NY (US)

( * ) Notice: Subject to any disclaimer, the term of this patent is extended or adjusted under 35 U.S.C. 154(b) by 699 days.

(21) Appl. No.: 15/828,301

(22) Filed: Nov. 30, 2017

(65) Prior Publication Data

US 2019/0166656 A1 May 30, 2019

(51) Int. Cl.

| | |
|---|---|
| ***H05B 6/06*** | (2006.01) |
| ***F24C 7/08*** | (2006.01) |
| ***F24C 3/12*** | (2006.01) |
| ***H05B 1/02*** | (2006.01) |
| *F24C 15/10* | (2006.01) |

(52) U.S. Cl.

CPC ..... *H05B 6/062* (2013.01); *F24C 3/126* (2013.01); *F24C 7/083* (2013.01); *H05B 1/0266* (2013.01); *F24C 15/106* (2013.01); *H05B 2213/05* (2013.01)

(58) Field of Classification Search

CPC ..... H05B 3/68; H05B 2213/05; H05B 3/76; H05B 3/681; H05B 6/062; H05B 1/0266; F24C 3/126; F24C 7/083; F24C 15/106; F24C 3/122; F24C 7/08; F23N 5/242

USPC ..... 219/412, 518, 621

See application file for complete search history.

(56) References Cited

U.S. PATENT DOCUMENTS

| | | | |
|---|---|---|---|
| 4,319,109 | A | 3/1982 | Bowles |
| 4,756,336 | A | 7/1988 | Amezcua |
| 5,900,174 | A | 5/1999 | Scott |

(Continued)

FOREIGN PATENT DOCUMENTS

| | | | |
|---|---|---|---|
| CN | 2835843 | Y | 11/2006 |
| CN | 201421114 | Y | 3/2010 |

(Continued)

OTHER PUBLICATIONS

"Automatic Stove Turn-Off Devices", This Caringhome.org, A Project of Well Cornell Medical College, Downloaded on Aug. 25, 2017, <http://www.thiscaringhome.org/products/auto-stove-turn-off-devices.php>, 2 pages.

(Continued)

*Primary Examiner* — Phuong T Nguyen

(74) *Attorney, Agent, or Firm* — David B. Woycechowsky

(57) ABSTRACT

A stovetop assembly where on/off status of a burner is controlled, at least in part, based upon whether the body of a cookware vessel is: (i) placed on a burner to complete an electrical circuit (for example direct current conductive circuit) or magnetic circuit; or (ii) removed from the burner to break the electrical or magnetic circuit. Also, a control box with a tether line extending therefrom that controls on/off status of a burner based, at least in part, upon whether a clip at a distal end of the tether line is mechanically connected to a cookware vessel.

9 Claims, 6 Drawing Sheets

(56) References Cited

U.S. PATENT DOCUMENTS

| | | | | |
|---|---|---|---|---|
| 6,140,617 | A | 10/2000 | Berkcan | |
| 6,253,761 | B1 | 7/2001 | Shuler | |
| 6,452,136 | B1 | 9/2002 | Berkcan | |
| 9,439,530 | B2 | 9/2016 | Logan | |
| 2002/0113062 | A1 | 8/2002 | Cranford | |
| 2005/0098170 | A1 | 5/2005 | Raynor | |
| 2012/0132646 | A1* | 5/2012 | England | H05B 6/062 219/622 |
| 2014/0124501 | A1* | 5/2014 | Shaffer | H05B 6/1254 219/621 |
| 2016/0076775 | A1 | 3/2016 | Luongo | |
| 2016/0374501 | A1 | 12/2016 | Logan | |

FOREIGN PATENT DOCUMENTS

| | | | |
|---|---|---|---|
| CN | 201697179 | U | 1/2011 |
| CN | 202442367 | U | 9/2012 |
| CN | 202736221 | U | 2/2013 |
| CN | 205174464 | U | 4/2016 |
| JP | 2013181729 | A | 9/2013 |
| WO | PCT-2008031645 | A1 | 3/2008 |

OTHER PUBLICATIONS

"Automatic Stove/Oven Control"; Aizstore, Downloaded on Aug. 25, 2017, <http://www.alzstore.com/automatic-oven-control-p/0352.htm>, 6 pages.

"Safety and Energy Saving Feature for Household Appliances", An IP.com Prior Art Database Technical Disclosure, Authors et. al.: Disclosed Anonymously, IP.com No. IPCOM000225693D, IP.com Electronic Publication Date: Feb. 26, 2013, 3 pages.

"Temperature Control System for an Induction Cooktop", An IP.com Prior Art Database Technical Disclosure, Authors et. al.: Disclosed Anonymously, IP.com No. IPCOM0001910580, IP.com Electronic Publication Date: Dec. 14. 2009, 5 pages.

Manu et al., "Automatic Gas Stove With Advanced Safety Features", Second International Conference on Recent Advances in Science & Engineering—2015, © ISRASE 2015, ISRASE explore Digital Library, 4 pages.

"Cookware and bakeware", Wikipedia, This is an old revision of this page, as edited by Jim1138 (talk | contribs) at 01:34, Aug. 23, 2017, 14 pages.

"Customized Countertop Induction Unit", An IP.com Prior Art Database Technical Disclosure, Authors et. al: Disclosed Anonymously, IP.com No. IPCOM000191329D, IP.com Electronic Publication Date: Dec. 29, 2009, 6 pages.

* cited by examiner

STOVE CONTROL SAFETY MECHANISM

BACKGROUND

The present invention relates generally to the field of automatic shut off for stovetop burners.

It is known to have timer controlled automatic shut off for stovetop burners in order to prevent overheating and smoke/fire.

It is known to have automatic on/off control for stovetop burners based, at least in part, upon the body of a cooking vessel completing an inductive circuit. The completion of the inductive circuit by the body of the cooking vessel heats up the vessel. Only certain materials may be used to make the cooking vessel, or it will not complete the inductive circuit. Herein, this type of stovetop burner will be referred to as an "inductive stovetop burner," or, more simply, as an "inductive burner." While inductive burners are a known technology, they should not be confused with non-inductive burners, such as conventional household stove electric burners and conventional household stove gas burners.

It is known to have automatic on/off control for stovetop burners based, at least in part, upon the body of a cooking vessel that is placed on the burner having an influence on a magnetic field generated by a device built into the burner.

It is known to have automatic on/off control for stovetop burners based, at least in part, upon the body of a cooking vessel that is placed on the burner having an influence on a magnetic mechanical switch built into the burner.

It is known to have automatic on/off control for stovetop burners based, at least in part, upon the weight of a cooking vessel that is placed on the burner closing a mechanical switch built into the burner.

It is known to have automatic on/off control for stovetop burners based, at least in part, upon the body of a cooking vessel that is placed on the burner having an influence on light waves detected by an optical sensor (for example, the cooking vessel changes the shape of a cooking flame when placed on the stovetop burner).

U.S. Pat. No. 6,452,136 ("Berkcan") states as follows: "Monitoring and control system and method for sensing of a vessel and other properties of a cooktop . . . . An apparatus that determines properties of a cooktop is provided. The cooktop includes a cooktop surface and a vessel that is selectively placed on the cooktop surface. The apparatus comprises a radiation sensor positioned below the cooktop surface. The radiation sensor senses at least a portion of, at least one of reflected radiation and ambient radiation that are provided above the cooktop surface and that pass through the cooktop surface. The radiation sensor also generates a detected radiation signal based on the sensed radiation. A processor is connected to the radiation sensor, and the processor determines properties of the cooktop from analyzing the detected radiation signal."

SUMMARY

According to an aspect of the present invention, a stovetop burner assembly is for use with a cookware vessel. The assembly includes: a first non-inductive burner sub-assembly including a vessel support hardware set and a non-inductive burner hardware set; and a control module. The control module is operatively connected to the first non-inductive burner hardware set to control on/off status of the first non-inductive burner hardware set. The vessel support hardware set includes two vessel receiving portions located in a spaced apart relationship so that the cookware vessel contacts of the two vessel receiving portions when the cookware vessel is placed on the vessel support hardware set. The control module is structured, programmed and/or connected to provide an electromagnetic signal to the two vessel receiving portions of the vessel support hardware set. The control module is connected, structured and/or programmed to control the on/off status of the first non-inductive burner hardware set in a manner that is based, at least in part upon whether the cookware vessel is in contact with both of the two vessel receiving portions of the vessel support hardware set.

According to a further aspect of the present invention, a stovetop burner assembly is for use with an electrically conductive cookware vessel. The assembly includes: a first burner sub-assembly including a vessel support hardware set and a burner hardware set; and a control module. The control module is operatively connected to the first burner hardware set to control on/off status of the first burner hardware set. The vessel support hardware set includes two vessel receiving portions located in a spaced apart relationship so that the cookware vessel contacts of the two vessel receiving portions when the cookware vessel is placed on the vessel support hardware set. The control module is structured, programmed and/or connected to provide an electrical potential across the two vessel receiving portions of the vessel support hardware set. The control module is connected, structured and/or programmed to control the on/off status of the first burner hardware set in a manner that is based, at least in part upon whether the electrically conductive cookware vessel is in contact with both of the two vessel receiving portions of the vessel support hardware set to form an electrically conductive circuit across the two vessel receiving portions.

According to a further aspect of the present invention, a stovetop burner control assembly is for use with a cookware vessel and a stove including a first stovetop burner. The assembly includes: a control module is operatively connectable to the stove to control on/off status of the first stovetop burner; a clip sub-assembly structured to be detachably mechanically connectable to the cookware vessel; an elongated, flexible tether line having a first end and a second end. The first end of the tether line is mechanically connected to the control module. The second end of the tether line is mechanically connected to the clip assembly. The control module is connected, structured and/or programmed to control on/off status of the first stovetop burner based, at least in part, upon whether the clip member is detachably mechanically connected to the cookware vessel.

DETAILED DESCRIPTION

Figure 1B:
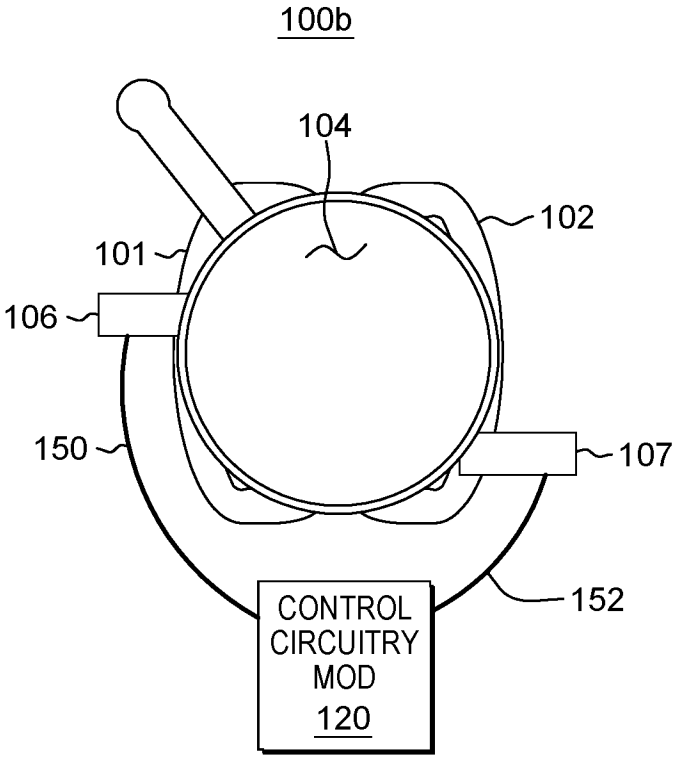
FIG. 1B is another top orthographic view of the first embodiment stovetop environment.

Some embodiments of the present invention may recognize one, or more, of the following facts, observations, potential problems and/or short comings with respect to the current state of the art: (i) another known countermeasure is to use weight sensors in the burners, however, the end user would need to buy a stove with weight sensors integrated; (ii) this may result in more problems such as the burner not being able to fit the stove; (iii) the use of motion sensor detection/timers requires setup beforehand—the person must set a time to let the technology know how long it should be left unattended for; (iv) however, this prior knowledge is not always known and those forgetting the setup may not reap the benefits; (v) there are also induction stoves, however, the temperature control for these types of stoves aren't as good and there are people who cannot afford a brand new stove and need to resort to other technologies; (vi) the technology that uses a camera on the ventilation addresses the problem but only have alarms and do not actually turn off the stove; and/or (vii) as can be seen, the lack of automation in setup, proper fit of burners, and the need of specific technology are just some of the drawbacks with respect to the current state of the art.

Some embodiments of the present invention are directed to a stove for use with a piece of cookware, where the stove includes a first burner (there will typically be more than one burner), a flexible tether line, an attachment mechanism located at a distal end of the tether line and an automatic shut off module. The attachment mechanism allows the distal end of the tether line to be detachably mechanically connected to a piece of cookware on, or at least near, to the first burner. The automatic shut off module includes machine logic to: (i) allow the burner to remain on so long as the distal end of the tether line is detachably attached to a piece of cookware by the attachment mechanism; and (ii) automatically turns off the first burner if: (a) the burner is on, and (b) the attachment mechanism has become mechanically disconnected from the piece of cookware for a predetermined amount of time (this predetermined amount of time may be zero time in embodiments with immediate automatic shut off). Other embodiments of the present invention are directed to a device that can be installed to a stovetop with a burner that includes the aforementioned tether, attachment mechanism and automatic shut off module.

Some embodiments of the present invention may include one, or more, of the following features, advantages, characteristics and/or operations: (i) technology that is integrated seamlessly in the stove cooking process; (ii) works for both gas or electric burners; (iii) a very flexible design that can fit on a majority of stoves that are sold; (iv) a stovetop device where the determination of whether a stove top burner is turned on and functioning at a given time is based, at least in part, upon completion of a circuit caused by the presence of cookware; (v) a control box to be placed over the traditional knobs on a stove; (vi) a control box to be placed over the traditional knobs on a stove that adds more controls over the use of burners, one being an auto-shut off control; (vii) technologies are potentially critical in saving lives and preventing home fires; (viii) usable with currently conventional cookware made of a wide variety of heat conductive materials (for example, aluminum, stainless steel, cast iron, carbon steel, and coated cookware; (ix) because all these materials listed in the foregoing item on this list conduct heat, they can also conduct electricity; (x) as a result, some embodiments are directed to a stove safety burner that makes the cookware itself complete the circuit; and/or (xi) once the cookware is removed, the stove turns off and thus, prevents a heating element from potentially burning the house down.

Some embodiments of the present invention may include one, or more, of the following features, advantages, characteristics and/or operations: (i) addresses the largest source of home fires (that is, people forget to turn the stove off) in a seamless manner; (ii) a new type of stove top that can be placed inside of both electric and gas stoves and causes the cookware to become the integral part of the on/off switch of the stove; (iii) cookware must be conductive by nature so putting electricity through it is not a problem; (iv) in the case of the electric stove top, one can turn on the stove but since there is no contact between both sides of the heating element, the stove will not be hot and thus, not a safety concern; (v) if a person wanted to begin cooking, he or she would have to place the cookware on top of the stove and the heating element would start to heat up and cook the food; and/or (vi) once the food is done and the cookware is removed from the stove, the circuit is no longer complete and again provides no safety concerns.

Some combustion stove (for example, gas stove) embodiments of the present invention may include one, or more, of the following features, advantages, characteristics and/or operations: (i) the electricity is sent from a separate control box which has control over the gas output as well as the ignitor; and/or (ii) with electrical signal based control over both the gas output and the igniter, when a person puts the pot onto the stove, the pot would cause the stove to be turned on if the temperature knob is set to the correct temperature.

Figure 1A:
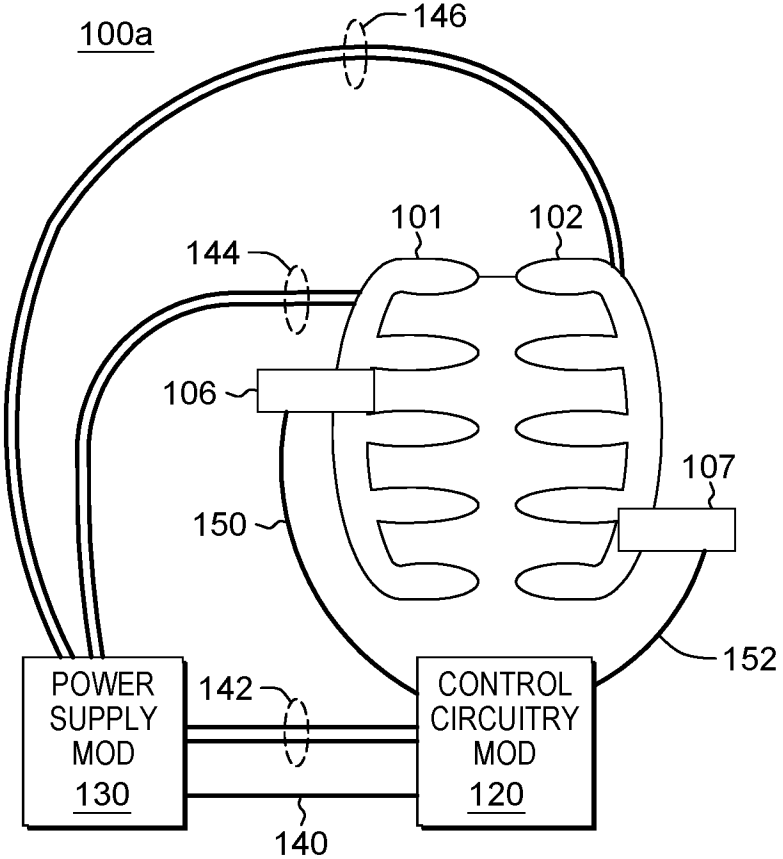
FIG. 1A is a top orthographic view of a stovetop environment according to a first embodiment of the present invention.

As shown in FIGS. 1A and 1B, electrically heated stovetop environment 100*a* (conductive pot removed position), 100*b* (conductive pot in place position) includes: first side electrical heater element 101; second side electrical heater element 102; electrically conductive cookware vessel 104; first side control interface clip 106; second side control interface clip 107; control circuitry module ("mod") 120; power supply mod 130; control-to-power-supply control signal line 140; first power line 142; second power line 144; third power line 146; first side contact control signal line 150; and second side contact control signal line 152.

Before turning to operation of the embodiment of environment 100*a*, 100*b*, some terminology will be defined. The stovetop burner of embodiment 100*a*, 100*b* is an example of a "non-inductive burner." This means that it generates thermal energy in some way that does not involve electromagnetic induction. Most currently conventional stovetop burners are non-inductive burners. This may be due, at least in part, to the fact that inductive burners require special stovetop cookware and may have other operational drawbacks. There are two currently popular types of non-inductive burners as follows: (i) electro-resistive type (for example, conventional burners that convert direct electrical current to heat using a heating coil or other resistive element); and (ii) combustion type that creates thermal energy by combustion of fuel (for example, a burner on a conventional gas stovetop). One technological insight involved in some embodiments of the present invention is that automatic on/off control based on location of a cooking vessel with respect to an inductive stovetop burner has been relatively well-developed, but similar technology for non-inductive burners (which are considerably more common) has not been as well developed.

Before turning to the automatic on/off control features that exist in this embodiment, the basic operation of causing elements 101, 102 to generate thermal energy (that is, heat) will now be discussed. When the machine logic of control circuitry mod 120 determines that the heating status of the stovetop burner should go from off to on, then a turn-on control signal is sent from control circuitry mod 120, through control-to-power-supply control signal line 140 and to power supply mod 130. Receipt of this control signal causes power supply mod 130 to send electrical power through power lines 144, 146 to electrically resistive conductors (not separately shown) inside of elements 101, 102. The heating elements will heat up in response to the electrical current from the power supply mod, but they do not conduct any substantial amount of electricity to, or through, their exterior surfaces. In this embodiment, a necessary condition for control circuitry mod 120 to send a control signal to turn on the heat is that a user must set a control (not shown in FIGS. 1A and 1B) to a "heater on" setting. Alternatively, in other embodiments, the user may also set a degree of desired heat (for example, low, medium, high)—this information would also be sent from mod 120 through line 140 to mod 130.

Now discussion will shift to the automatic on/off operation of the embodiment of environment 100*a*, 100*b*. The machine logic of control circuitry mod 120 is structured and/or programmed so that a necessary condition for the heat to come on and also to remain on is that an electrically conductive cookware vessel (such as electrically conductive cookware vessel 104) must be in a position on the burner such that it completes an electrical current conducting circuit (as opposed to an inductive circuit, a magnetic circuit or other type of circuit) between the exterior surface of element 101 and the exterior surface of element 102. As shown in FIG. 1A, there is empty space between elements 101 and 102 when the cookware is not in place. As shown in FIG. 1B, when electrically conductive cookware vessel 104 is put in place, then an electrical circuit is completed, which electrical circuit includes the following portions: (i) control circuitry mod 120; (ii) first side contact control signal line 150; (iii) clip 106; (iv) exterior surface of first side element 101; (v) electrically conductive cookware vessel 104; (vi) exterior surface of second side element 102; (vii) clip 107; and (viii) second side contact control line 152. To further explain, mod 120 uses direct current electrical energy (received from mod 130 through first power line 142) to generate a direct current type potential between elements 101 and 102. However, these elements are spaced apart, which means that no electrical energy flows between them unless electrically conductive cookware vessel 104 is placed in contact with both elements to complete the electrical circuit. When the vessel is in place (and the user control has set the burner to be on), then the flow of current through the circuit will act as an input that causes the machine logic of control circuitry module to turn on the stovetop burner. When the vessel is removed, then the circuit is broken, which will cause the machine logic of control circuitry 120 to turn off the stove top burner.

While the embodiment of environment 100*a*, 100*b* uses direct current for its conductive cookware vessel presence switched automatic on/off control, alternatively, alternating current could be used.

While the embodiment of environment 100*a*, 100*b* will immediately turn the stovetop burner on or off in response to presence/absence of electrically conductive cookware, control circuitry mod 120 could be structured and/or programmed with time delays so that transient connections/disconnections of the control circuit do not immediately cause a change in stovetop burner on/off status.

While the embodiment of environment 100*a*, 100*b* uses the exterior surfaces of elements 101 and 102 as part of the control circuit, alternatively, it could be required that the electrically conductive cookware vessel make simultaneous contacts with both clips 106, 107 to complete the circuit as a necessary condition for having the stovetop burner turned on. In these embodiments, there would not need to be two separate heating elements, so long as the clips are electrically insulated from, or by, the exterior surface of the single piece heating element.

While the embodiment of environment 100*a*, 100*b* uses attachable detachable clips 106, 107, alternatively, the electronic and/or mechanical attachment between the control lines and the heating elements could be: (i) permanent; and/or (ii) physically integrated into the structure of the heating element(s).

In the embodiment of FIGS. 1A and 1B, first side control interface clip 106 and second side control interface clip 107 are an example of what is sometimes more generically referred to herein as "vessel receiving portions." Speaking more generally, vessel receiving portions are spaced apart members across which a cookware vessel can be placed to complete an electrical (for example, conductive, capacitive, inductive) circuit or a magnetic circuit (for example, if the vessel receiving portions include electromagnetic coils that can induce magnetic lines of flux and/or have current induced in them by magnetic fields).

In the embodiment of FIGS. 1A and 1B, the "vessel support hardware set" is made up of first side electrical heater element 101; second side electrical heater element 102; first side control interface clip 106; and second side control interface clip 107. Speaking more generally, a vessel support hardware set is any set of hardware that mechanically supports a cookware vessel on, or over, the burner. In the embodiment of FIGS. 1A and 1B, the heating elements (that is heater elements 101, 102) form a part of the vessel support hardware set, but they are separate piece parts from the vessel receiving portions (clips 106, 107) that also form a part of the vessel support hardware set. As will be seen below in the discussion of the embodiment of FIGS. 2A and 2B, the vessel support hardware set may be separate from the heat source of the burner. As will also be seen, below in the embodiment of FIGS. 2A and 2B, the vessel support hardware set and the vessel receiving portions may be unitarily integrated so that they are the same thing. In some embodiments, the vessel receiving portions may be electrically and/or magnetically insulated from the rest of the vessel support hardware set.

In the embodiment of FIGS. 1A and 1B, the circuit completed by the cookware vessel in an electrical conduction circuit. In other embodiments, other types of circuits may be completed/broken by placing/removing the cookware vessel. These other types of electromagnetic circuits may include electrical capacitive circuits, electrical inductive circuits and/or magnetic circuits (that depended upon magnetic lines of flux flowing through the body of a cookware vessel made of magnetically permeable material).

In the embodiment of FIGS. 1A and 1B, there are separate two heater elements (with electro-resistive elements contained in internal cavities defined therein) where each vessel receiving portion is connected to a different heater element. In other embodiments, there may be a single heater element (for example, a spiral shaped single heater element) with the vessel receiving elements attached thereto in a mutually spaced apart fashion. However, in these embodiments, it may be necessary to electrically and/or magnetically insulate the vessel receiving portions (for example, clips 106, 107) from the exterior surfaces of the heater element to which they are both mechanically connected.

Figure 2B:
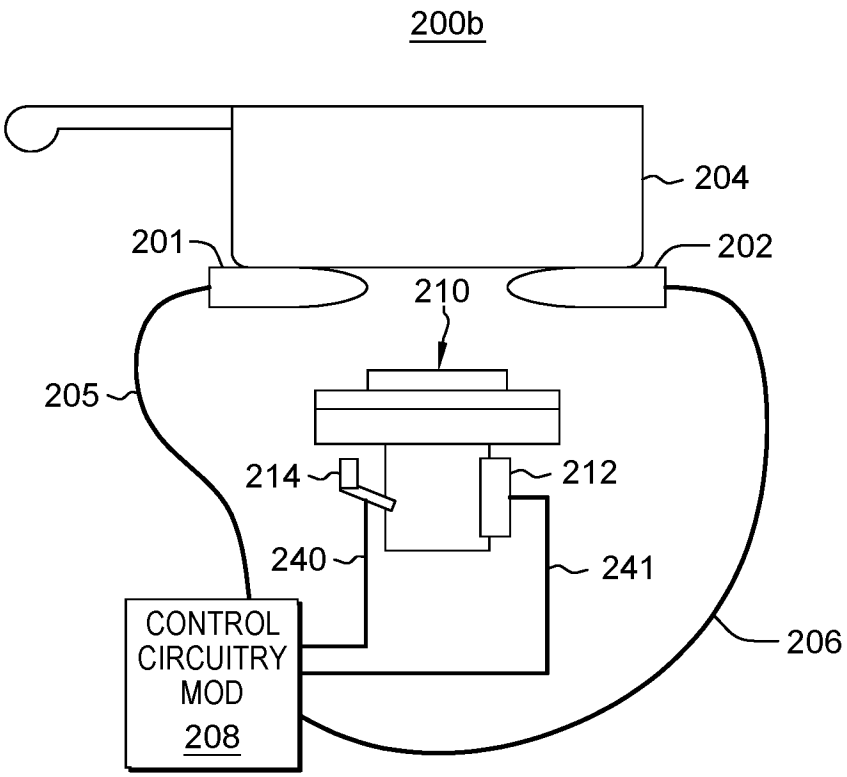
FIG. 2B is another top orthographic view of the second embodiment stovetop environment.
Figure 2A:
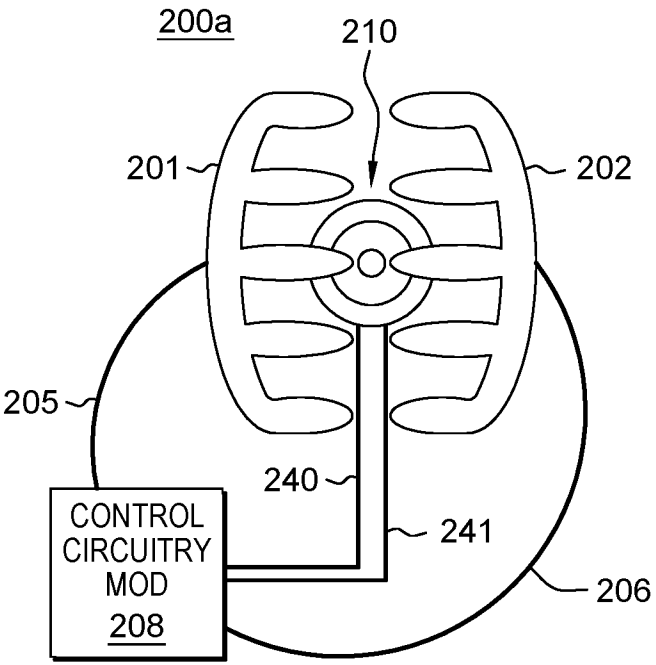
FIG. 2A is a top orthographic view of a stovetop environment according to a second embodiment of the present invention.

As shown in FIGS. 2A and 2B, combustion heated stovetop environment 200*a* (conductive pot removed position), 200*b* (conductive pot in place position) includes: first side vessel support member 201; second side vessel support member 202; electrically conductive cookware vessel 204; control circuitry module ("mod") 208; first side contact control signal line 205; and second side contact control signal line 206; combustion burner sub-assembly 210 (including fuel inlet valve 212 and igniter hardware 214); igniter control signal line 240; and fuel valve control signal line 241. The embodiment of environment 200*a*, 200*b* includes a combustion type stovetop burner that creates thermal energy by combustion of gas. In this embodiment, the automatic on/off hardware is retrofitted into a pre-existing gas stovetop. Alternatively, a new stove may be originally instructed to include the features of an embodiment of the present invention.

Before turning to the automatic on/off control features that exist in this embodiment, the basic operation of causing combustion burner sub-assembly to generate thermal energy (that is, heat) will now be discussed. When the machine logic of control circuitry mod 208 determines that the heating status of the stovetop burner should go from off to on, then: (i) a first turn-on control signal is sent from control circuitry mod 208, through fuel valve control signal line 241 and to valve 212 in order to start the flow of fuel through sub-assembly 210; and (ii) a second turn-on control signal is sent from control circuitry mod 208, through igniter control signal line 240 and to igniter 214 to cause ignition of the fuel stream. There will now be a flame for heating up the contents of vessel 204. A third control signal may be sent intermittently from control circuitry mod 208 to valve 212 when a user adjusts the degree of desired fuel flow and consequent heat (for example, low, medium, high).

Now discussion will shift to the automatic on/off operation of the embodiment of environment 200*a*, 200*b*. The machine logic of control circuitry mod 220 is structured and/or programmed so that a necessary condition for the heat to come on and also to remain on is that an electrically conductive cookware vessel (such as electrically conductive cookware vessel 204) must be in a position on the support members 201, 202 such that it completes an electrical current conducting circuit (as opposed to an inductive circuit, a magnetic circuit or other type of circuit) between the exterior surface of support member 201 and the exterior surface of support member 202. As shown in FIGS. 2A and 2B, there is empty space between members 201 and 202 when the cookware is not in place. As shown in in FIG. 2B, when electrically conductive cookware vessel 204 is put in place, then an electrical circuit is completed through the cookware, the support members and lines 205 and 206. When the cookware is removed, then the circuit is broken and control circuitry mod 220 will detect this and close valve 212 to stop the combustion and the flow of gas.

Figure 3:
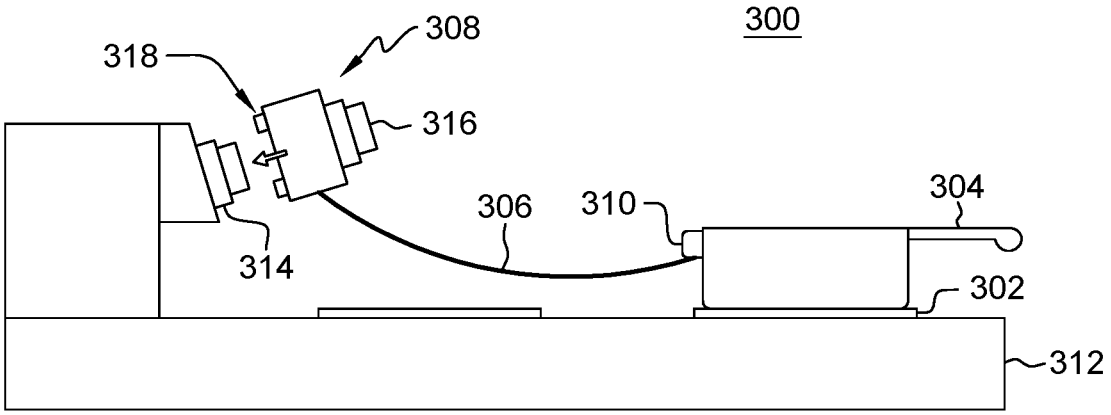
FIG. 3 is a left side orthographic view of a stovetop environment according to a third embodiment of the present invention.
Figure 4:
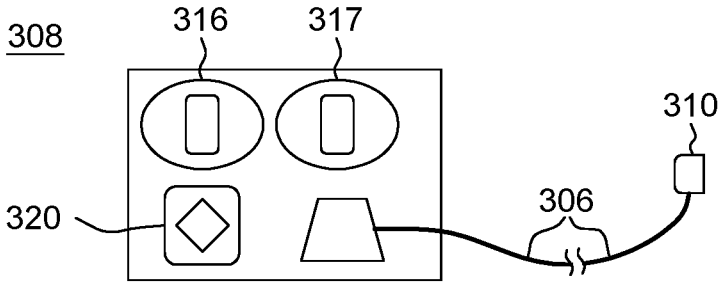
FIG. 4 is a front orthographic view of a portion of the third embodiment stovetop environment.

As shown in FIGS. 3 and 4, electro-resistive heating stovetop environment 300 includes: first electro-resistive burner 302; cookware vessel 304; tether line 306; control box sub-assembly 308; magnetic clip 310; stove frame 312; and current rotary heat control knob 314. Control box sub-assembly 308 includes first overlay knob 316; second overlay knob 317; control box securing device 318; and recess 320.

The embodiment of environment 300 provides seamless stove safety through the use of control box sub-assembly 308 that is placed over current rotary heat control knob 314 when sub-assembly 308 is secured to frame 312 by control box securing device 318. More specifically, sub-assembly 308 includes control electronics (not separately shown) that selectively drive first overlay knob 316 into rotation, to, in turn, drive current rotary heat control knob 314 into rotation in order to control: (i) on/off status of first electro-resistive burner 302; and (ii) degree of heat given off by the first electro-resistive burner. In this embodiment, a person may also turn first overlay knob 316 to override knob position determinations made by the control electronics of sub-assembly 308. While this embodiment is an electro-resistive type non-inductive stovetop, alternatively, a similar tether and/or control sub-assembly could be used on a combustion type non-inductive stovetop environment. The burner will only go on, and will only remain on, if magnetic clip 310 is mechanically connected to metal cookware vessel 304.

In this embodiment, control box securing device 318 uses threaded connectors. Alternatively, this device may use other mechanical connection hardware, such as magnets or adhesive strips.

In this embodiment, the control electronics of sub-assembly 308 include a timer that may be used to shut down the burners after they have been on for more than a predetermined amount of time.

In this embodiment, the on/off status of the burner is controlled by rotary actuation of overlay knobs 316, 317 and their interaction with the control knobs with which the stove was originally equipped. Alternatively or additionally, the control electronics of sub-assembly 308 could include an on/off switch for each burner.

Magnetic clip 310 can be secured in recess 320 when not in use.

The heat knob is used as normal, but the stove does not light unless the on switch is set in the on position and the timer switch has been cranked to a time greater than zero. The timer being set allows for a safety fall back mechanism by which the stove will turn off automatically when the timer pops.

The control electronics of sub-assembly 308 also include a magnetic auto turn off logic. This means that first electro-resistive burner 302 can only be set to on status when magnetic clip 310 is mechanically connected to cookware vessel 304. The operation of tether lines, like tether line 306, to control stovetop operations: (i) can be built directly into a stovetop (instead of being implemented through a control box sub-assembly like sub-assembly 308); and (ii) will be discussed in more detail, below.

In this embodiment, if magnetic clip 310 is not being used at the time the feature does nothing but if the magnet clip is attached to cookware vessel 304 then a signal is communicated through tether line 306 to the control electronics of sub-assembly 308. The magnet is not very strong so once the piece of cookware is removed from the stove and the short magnet string detaches from it, the signal drops and the control box turns off the stove element. With both the magnet and timer, the user is forced to set a certain time frame where the stove is used. This technology would prevent people from starting a stove fire if they leave the burner on.

Some embodiments of the present invention may include one, or more, of the following features, advantages, characteristics and/or operations: (i) replacing traditional stove burner control knob with a "smart knob" to provide stove safety features; (ii) smart knob on stove to ensure someone is aware of stove activity or shut off the stove if not; (iii) smart knob on stove to turn stove off when timers have popped; (iv) avoids need for a temperature sensor or temperature as a variable at all; and/or (v) ensures that the stove does not cause remain on for too long or cause fires.

Three more specific embodiments of the tether line aspect of the present invention will now be respectively discussed with reference to FIGS. 5 to 7.

Figure 5:
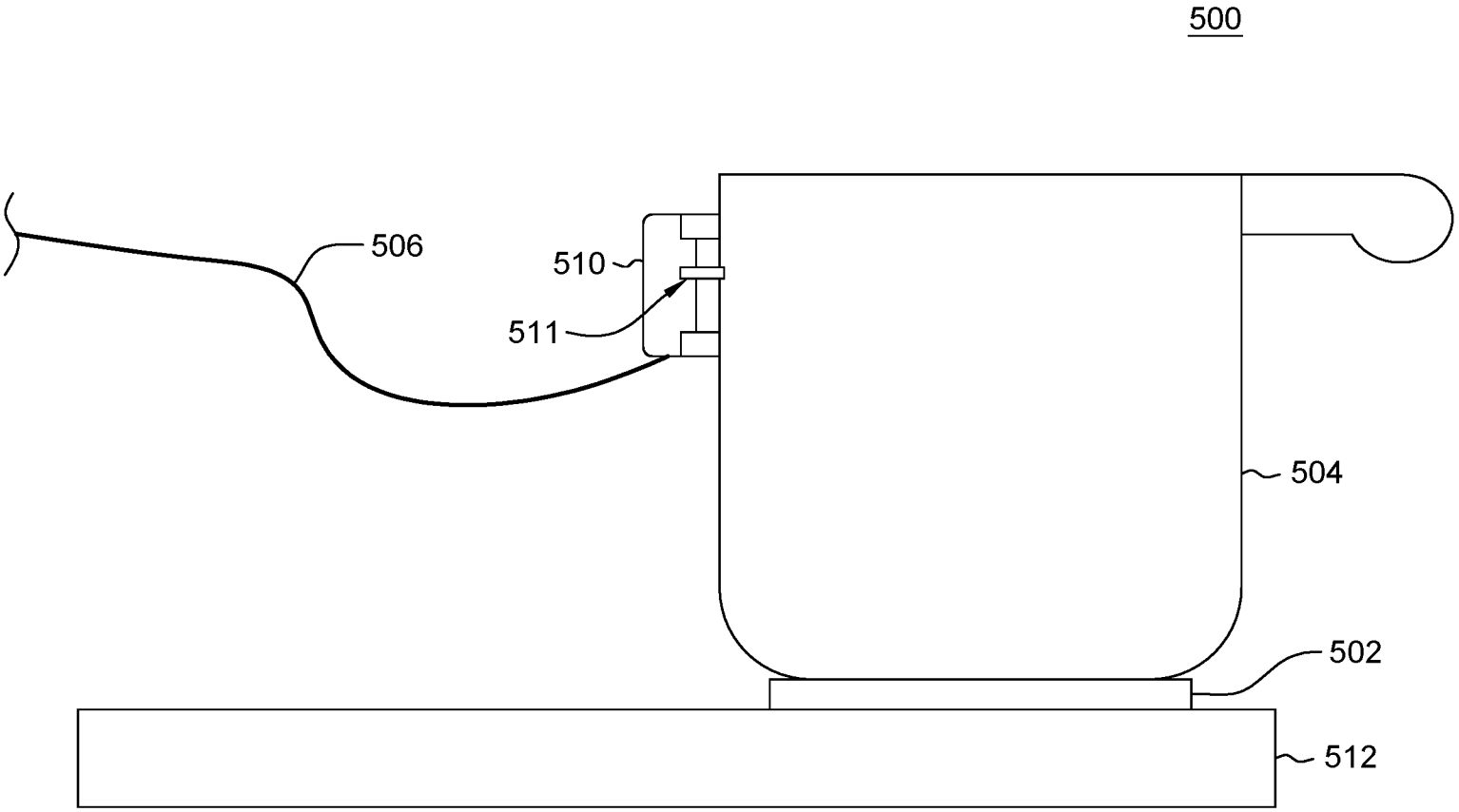
FIG. 5 is a left side view orthographic view of a stovetop environment according to a fourth embodiment of the present invention.

As shown in FIG. 5, tethered vessel system 500 includes: burner 502; metal vessel 504 (must be made of a type of metal to which a magnet will stick); tether line (also called control line) 506; magnetic clip 510; capacitance connection hardware 511; and stove frame 512. Capacitance connection hardware 511 uses magnetic capacitance to effectively detect the fact that vessel 504 is mechanically connected to magnetic clip 510. Tether line 506 includes two wires (not separately shown) as follows: (i) one wire sending a voltage out to capacitance connection hardware 511; and (ii) one wire that returns that signal. When magnetic clip 510 is mechanically connected to vessel 504, capacitance connection hardware 511 contacts vessel 504 and returns the signal back to control electronics for the stovetop (not shown in FIG. 5) through tether line 506. When a user completes cooking, and takes the cookware away, the magnets come off and the capacitance sensor no longer senses the cookware it stops the voltage flow, triggering the control box to detect a voltage drop and turn off the stove.

Figure 6:
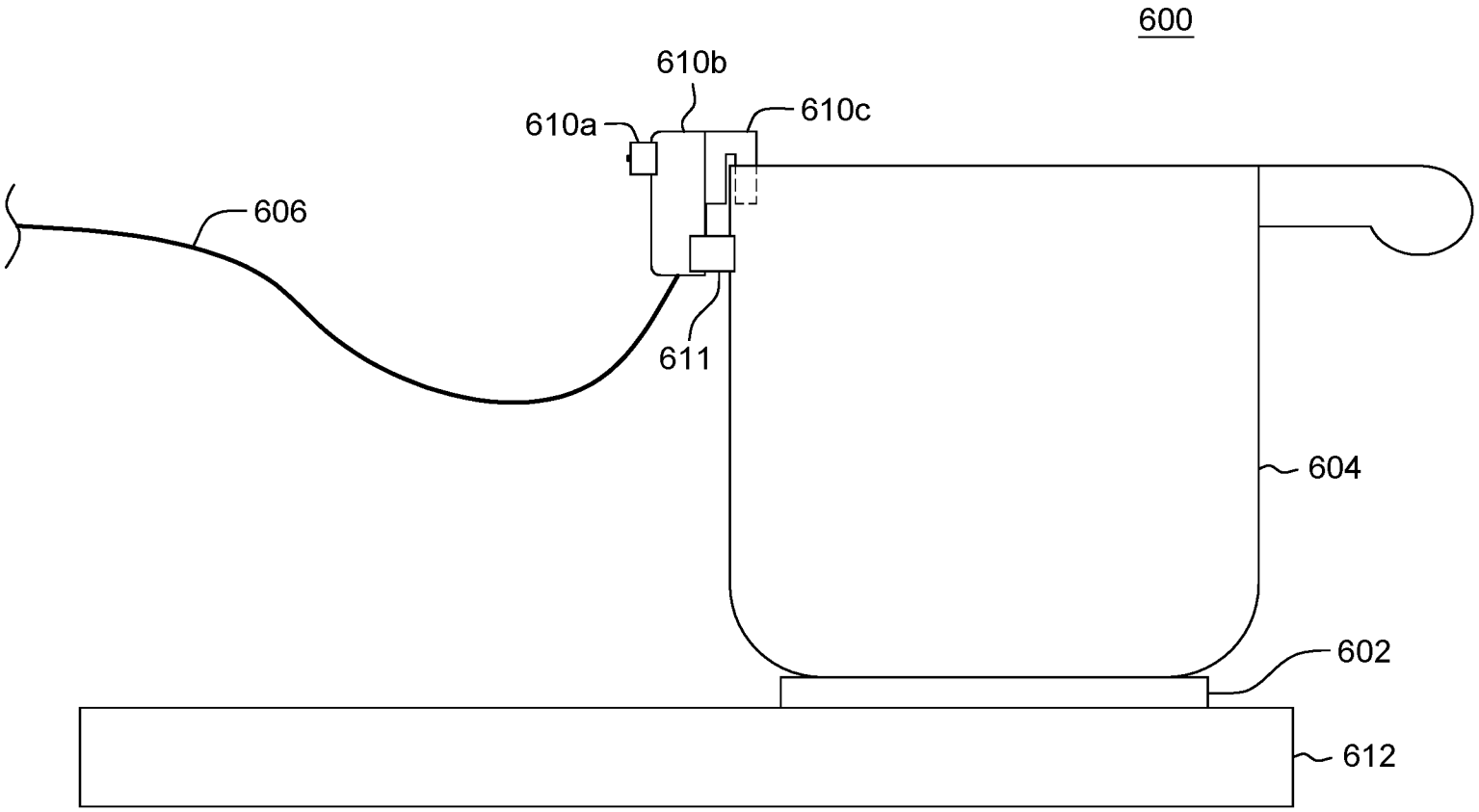
FIG. 6 is a left side view orthographic view of a stovetop environment according to a fifth embodiment of the present invention.

As shown in FIG. 6, tethered vessel system 600 includes: burner 602; capacitive vessel 604; tether line (also called control line) 606; hook attach/retract button 610*a*; clip main body 610*b*; attachment hook 610*c*; capacitance connection hardware 611; and stove frame 612. Tether line 606 is made of two wires, one sending a voltage out to the attached device and one that returns that signal to control electronics for the stovetop. The device is attached to the piece of cookware via a clip that is open and closed via a button on the outside of the attached device. When the device is attached a capacitance sensor protrudes from the device and touches the cookware to detect the presence of the cookware. Either when the clip is triggered or the capacitance sensor detects a piece of cookware the voltage returned to the control block is high indicating that the stove is in use. When the clip is not triggered or the capacitance sensor no longer detect that something is present the return voltage drops to zero and triggers the control box to turn off the stove.

Figure 7:
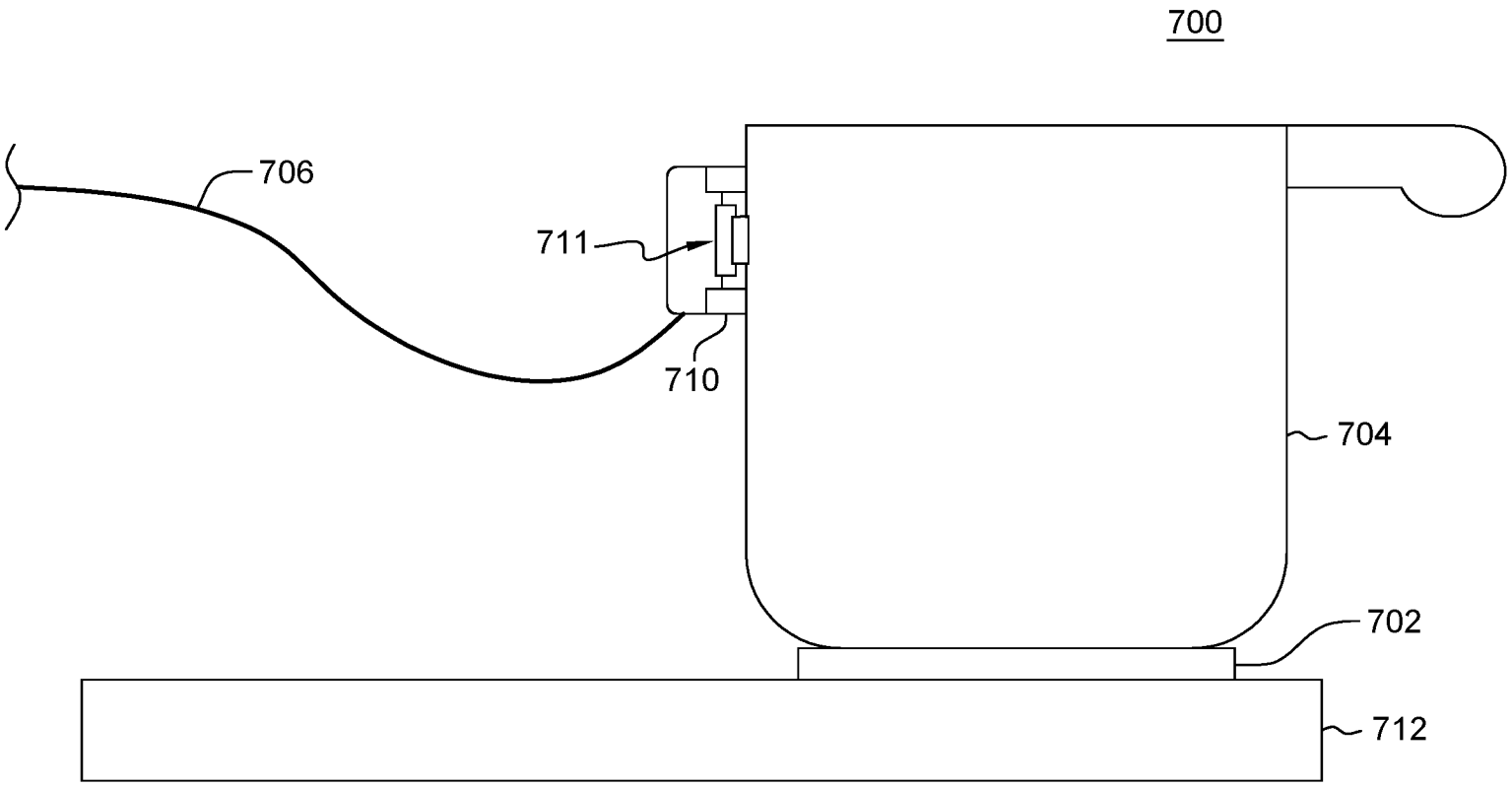
FIG. 7 is a left side view orthographic view of a stovetop environment according to a sixth embodiment of the present invention.

As shown in FIG. 7, tethered vessel system 700 includes: burner 702; capacitive vessel 704; tether line (also called control line) 706; magnet link 710; control button 711; and stove frame 712. Tether line 706 is made of two wires, one sending a voltage out to the attached device and one that returns that signal to the control electronics for the stovetop. The device is attached to the piece of cookware via two magnets on the device. When the device is attached there is a push button that is pressed down against the side of the piece of cookware. When the push button is pressed down, the voltage is sent back to the control electronics. When the user completes cooking, and takes the pot away, the magnets come off and the push button goes back to its resting position (zero volts) stopping the voltage flow. When the control electronics sense this voltage drop the control electronics turn off the stove.

In some embodiments of tether lines according to the present invention, the tether line is made of two wires that send voltage to and from the attachment device to make a complete circuit. However, this does not necessarily mean that any substantial current flows through the body of the cookware vessel (unlike the embodiments of FIGS. 1 to 4). For example, if the circuit uses the vessel as a capacitive circuit element (as opposed to a conductive circuit element), then electrical current does not need to flow through the body of the cookware vessel to detect its presence and to effectively communicate that information through the tether line. In some embodiments, the signal/signals sent through the tether line are simply a high or low voltage, the exact amount of voltage is not important.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

The following paragraphs set forth some definitions for certain words or terms for purposes of understanding and/or interpreting this document.

Present invention: should not be taken as an absolute indication that the subject matter described by the term "present invention" is covered by either the claims as they are filed, or by the claims that may eventually issue after patent prosecution; while the term "present invention" is used to help the reader to get a general feel for which disclosures herein are believed to potentially be new, this understanding, as indicated by use of the term "present invention," is tentative and provisional and subject to change over the course of patent prosecution as relevant information is developed and as the claims are potentially amended.

Embodiment: see definition of "present invention" above—similar cautions apply to the term "embodiment."

and/or: inclusive or; for example, A, B "and/or" C means that at least one of A or B or C is true and applicable.

Including/include/includes: unless otherwise explicitly noted, means "including but not necessarily limited to."

Electrically Connected: means either directly electrically connected, or indirectly electrically connected, such that intervening elements are present; an electrical connection may include, but need not be limited to, elements such as capacitors, inductors, transformers, vacuum tubes, and the like.

Conductively connected: means directly electrically connected such that electrical current flows between the conductively connected elements.

Mechanically connected: Includes both direct mechanical connections, and indirect mechanical connections made through intermediate components; includes rigid mechanical connections as well as mechanical connection that allows for relative motion between the mechanically connected components; includes, but is not limited, to welded connections, solder connections, connections by fasteners (for example, nails, bolts, screws, nuts, hook-and-loop fasteners, knots, rivets, quick-release connections, latches and/or magnetic connections), force fit connections, friction fit connections, connections secured by engagement caused by gravitational forces, pivoting or rotatable connections, and/or slidable mechanical connections.

Module/Sub-Module: any set of hardware, firmware and/or software that operatively works to do some kind of function, without regard to whether the module is: (i) in a single local proximity; (ii) distributed over a wide area; (iii) in a single proximity within a larger piece of software code; (iv) located within a single piece of software code; (v) located in a single storage device, memory or medium; (vi) mechanically connected; (vii) electrically connected; and/or (viii) connected in data communication.

Electromagnetic signal to the two vessel receiving portions: any provision of electric energy to at least one of the two vessel receiving portions such that any type of electrical and/or magnetic circuit can be made across the two vessel receiving portions; types of electrical and/or magnetic circuits include: inductive circuits, capacitive circuits, electrically conductive circuits and/or magnetic circuits based at least in part on lines of magnet flux.

What is claimed is:

1. A stovetop burner assembly for use with a cookware vessel, the assembly including:

a first burner sub-assembly including a vessel support hardware set and a first burner hardware set; and a control module;

wherein:

the burner hardware set includes electro-resistive burner circuitry;

the control module is operatively connected to the first non-inductive burner hardware set to control on/off status of the electro-resistive circuitry of the burner hardware set;

the vessel support hardware set includes two vessel receiving portions located in a spaced apart relationship so that the cookware vessel contacts of the two vessel receiving portions when the cookware vessel is placed on the vessel support hardware set;

the control module is structured, programmed and connected to provide an electromagnetic signal to the two vessel receiving portions of the vessel support hardware set; and the control module is connected, structured and programmed to control the on/off status of the burner hardware set in a manner that is based, at least in part upon whether the cookware vessel is in contact with both of the two vessel receiving portions of the vessel support hardware set.

2. The assembly of claim 1 wherein:

the cookware vessel is made, at least in part, of electrically conductive material; and the control module is further connected, structured and programmed to control the on/off status of the burner hardware set in a manner that is based, at least in part upon whether the cookware vessel provides an electrical conduction path between the two vessel receiving portions of the vessel support hardware set.

3. The assembly of claim 2 wherein the control module is further connected, structured and programmed to provide a direct current type potential across the two vessel receiving portions.

4. The assembly of claim 1 wherein:

the cookware vessel is made, at least in part, of electrically capacitive material; and the control module is further connected, structured and programmed to control the on/off status of the burner hardware set in a manner that is based, at least in part upon whether the cookware vessel completes a capacitive circuit between the two vessel receiving portions of the vessel support hardware set.

5. The assembly of claim 1 wherein:

the cookware vessel is made, at least in part, of electrically inductive material; and the control module is further connected, structured and programmed to control the on/off status of the burner hardware set in a manner that is based, at least in part upon whether the cookware vessel completes an inductive circuit between the two vessel receiving portions of the vessel support hardware set.

6. The assembly of claim 1 wherein:

the cookware vessel is made, at least in part, of magnetic material; and the control module is further connected, structured and programmed to control the on/off status of the burner hardware set in a manner that is based, at least in part upon whether the cookware vessel provides a path for lines of magnetic flux between the two vessel receiving portions of the vessel support hardware set.

7. The assembly of claim 1 wherein:

the control module is connected, structured and programmed to turn on the burner hardware set when the cookware vessel is in contact with both of the two vessel receiving portions of the vessel support hardware set.

8. The assembly of claim 1 wherein:

the control module is connected, structured and programmed to turn off the burner hardware set when the cookware vessel is removed from contact with both of the two vessel receiving portions of the vessel support hardware set.

9. The assembly of claim 1 wherein the electro-resistive burner circuitry is at least partially located in an interior space defined by the vessel support hardware set.

* * * * *